US005269742A

United States Patent [19]

Crouch et al.

[11] Patent Number: 5,269,742

[45] Date of Patent: Dec. 14, 1993

[54] CARTON FLAP OPENING MECHANISM

[75] Inventors: G. William Crouch, Colchester; Warren Minkler, Higganum, both of Conn.

[73] Assignee: B & B Equipment Inc., Middletown, Conn.

[21] Appl. No.: 999,607

[22] Filed: Dec. 31, 1992

[51] Int. Cl.[5] ..... B31B 1/26

[52] U.S. Cl. ..... 493/177; 53/382.2; 493/309

[58] Field of Search ..... 493/309, 310, 312, 162, 493/183, 177, 409, 436, 446, 447, 453, 454; 53/382.2, 382.3, 492, 75, 564

[56] References Cited

U.S. PATENT DOCUMENTS

| | | | |
|---|---|---|---|
| 2,797,092 | 6/1957 | Welch . | |
| 2,890,560 | 6/1959 | Nigrelli et al. . | |
| 2,915,868 | 12/1959 | Copping . | |
| 2,918,773 | 12/1959 | Krupp | 53/382.2 |
| 2,929,183 | 3/1960 | Magna . | |
| 2,939,261 | 12/1960 | Calhoun . | |
| 2,982,075 | 5/1961 | Foster . | |
| 2,982,076 | 5/1961 | Shelton . | |
| 3,224,165 | 12/1965 | Nigrelli | 53/382.2 |
| 3,852,942 | 12/1974 | Johnson | 53/382.2 |
| 4,191,005 | 3/1980 | Vinoskey | 53/382.3 |
| 4,206,579 | 6/1980 | Woxland | 493/183 |
| 4,368,620 | 1/1981 | Johnson . | |
| 4,522,014 | 6/1985 | Robinson | 53/382.2 |
| 4,543,767 | 10/1985 | Wiseman | 53/382.3 |

*Primary Examiner*—Jack Lavinder

[57] ABSTRACT

A carton flap opening assembly for use in a carton conveying apparatus having a frame and a conveyor. The assembly includes a horizontally disposed arm having a mounting portion at one end and a flap engaging portion extending therefrom. The flap engaging portion has a generally planar trailing edge section at its outer end, and a depending arcuate leading edge portion with an upwardly extending end section therebehind. A rotating mechanism has mounting means supporting the mounting portion of the arm for rotation of the arm about a vertical axis spaced to one side of the conveyor path. A vertical motion mechanism supports the rotating mechanism and thereby the arm for movement vertically relative to the plane of the associated conveyor path and a control mean for operating the rotating and vertical motion mechanisms in response to the position of a carton moving along the conveyor path.

17 Claims, 7 Drawing Sheets

CARTON FLAP OPENING MECHANISM

BACKGROUND OF THE INVENTION

The present invention relates to devices for opening the flaps of cartons as they advance along a conveyor, and, more particularly, to devices for opening the flap at the leading edge of the carton as it is moving along the conveyor.

As is well known in the art, cartons into which products are to be inserted during the packaging operation are conventionally supplied in flat, unfolded form by the carton manufacturer to reduce shipping costs, and they are assembled by the packager into an erect form. Such cartons generally include four flaps at the upper end of the carton which must be opened in order to enable the insertion of the product thereinto.

Many devices have been proposed and utilized to open the flaps of the carton as it is being moved along a conveyor to a filling station, and the most difficult problem usually resides in the apparatus to open and fully fold over the flap which is at the leading edge of the carton as it is advancing on the conveyor. A number of patents have attempted to address this problem including Johnson et al U.S. Pat. No. 3,852,952 and Johnson U.S. Pat. No. 4,638,620, as well as other prior art patents which are referred to therein.

One of the problems associated with such flap opening devices is to provide a mechanism which can be readily adapted to different sizes and heights of cartons and different sizes of flaps and which will work reliably to effect the initial engagement under the flap and then effect the folding over of the flap as the carton is continuing to advance.

It is an object of the present invention to provide a novel apparatus for opening the leading flap of a carton and which is relatively simple to construct and facile in operation.

It is also an object to provide such a carton flap opening apparatus which may be positioned in a non-obstructing location at the side of the conveyor and which rapidly moves its opening element into engagement with the leading flap and continues such movement without interfering with other operations.

Another object is to provide such a carton flap opening apparatus which may be fabricated and assembled readily and which is relatively fool proof and long lived in operation.

SUMMARY OF THE INVENTION

It has now been found that the related objects may be readily attained in a carton flap opening assembly for use in a carton conveying apparatus having a frame and a conveyor providing a path along which cartons are moved. The assembly includes a horizontally disposed arm having a mounting portion at one end and a flap engaging portion extending therefrom. The flap engaging portion has a generally planar trailing edge section at its outer end, and a depending arcuate leading edge portion with an upwardly extending end section therebehind.

A rotating mechanism has mounting means supporting the mounting portion of the arm for rotation of the arm about a vertical axis spaced to one side of the conveyor path. A vertical motion mechanism supports the rotating mechanism and thereby the arm for movement vertically relative to the plane of the associated conveyor path.

There are also included means for mounting the vertical motion mechanism on the frame of the conveying apparatus, and control means for operating the rotating and vertical motion mechanisms in response to the position of a carton moving along the conveyor path.

Preferably, the arm is of generally U-shaped configuration providing a pair of fingers and a bight therebetween with the end of one finger providing the mounting portion, with the bight providing the trailing edge section, and with the depending leading edge and upwardly extending section being provided by the outer portion of the other finger. Desirably, the arm has an upstanding flange along its side adjacent the mounting portion, and the upwardly extending section also has an arcuate edge.

In the preferred embodiment, the control means operates the rotating mechanism to rotate the arm through approximately 180° to initially engage under the flap of an associated carton and pivot it into an open position while concurrently operating the vertical motion mechanism to raise and then lower the arm during the rotation as the flap is being pivoted into the open position. The vertical motion mechanism includes at least one cylinder and piston supporting the rotary motion mechanism, and this cylinder is secured to the mounting means. The rotary motion mechanism includes at least one cylinder and piston to rotate the mounting means for the arm.

DETAILED DESCRIPTION OF THE ILLUSTRATED EMBODIMENTS

Figure 1:
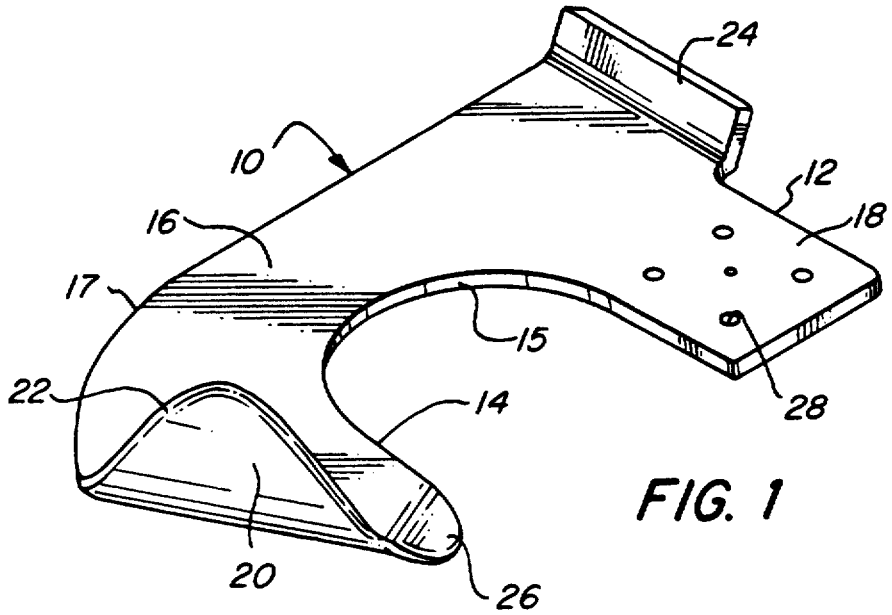
FIG. 1 is a perspective view of the carton opening arm utilized in the apparatus of the present invention.
Figure 2:
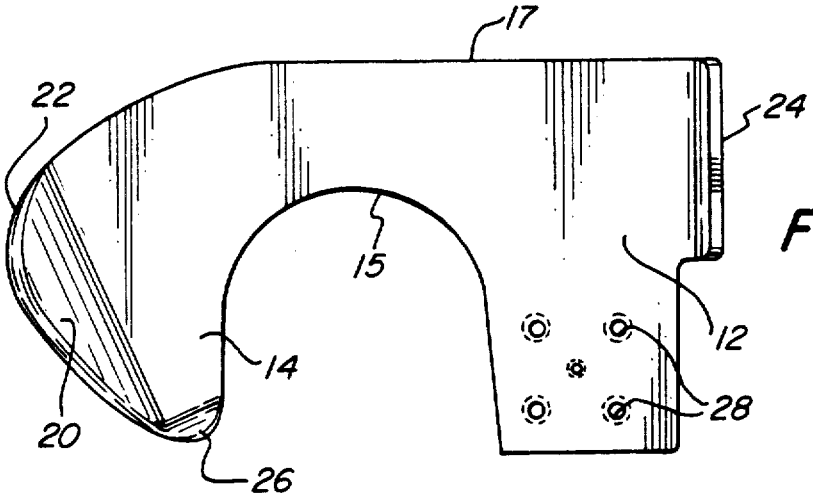
FIG. 2 is a plan view thereof.
Figure 4:
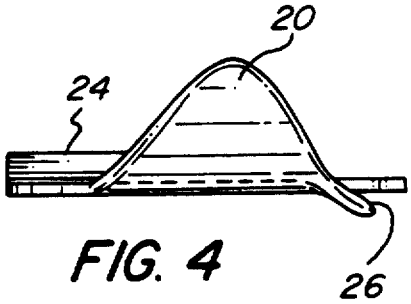
FIG. 4 is an outer end elevational view thereof.
Figure 3:
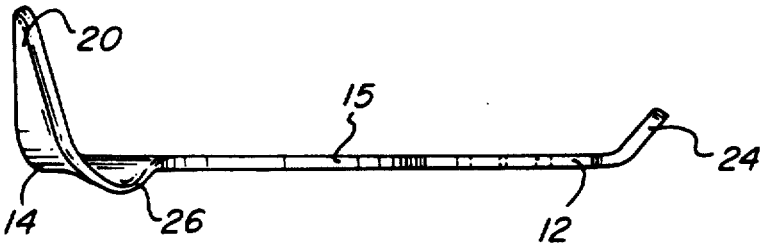
FIG. 3 is a leading edge elevational view thereof.

Turning first to FIGS. 1–4, an essential element of the apparatus of the present invention is the flap opening arm generally designated by the numeral 10 and which has relatively complex configuration. As can be seen, the arm 10 is of generally U-shaped configuration with a pair of fingers 12,14 and an interconnecting bight 16 behind the generally arcuate cutout 15. As can be seen, the finger 12 has a mounting portion 18 provided with apertures 28 to receive fasteners (not shown) and an upstanding flange 24 adjacent the trailing edge 17 of the arm and its purpose will be described more fully hereinafter. The finger 14 has an arcuate edge 22 which blends into the trailing edge 17 which is generally rectilinear. As can be seen, the finger 14 has the upwardly extending section 20 along its outer edge and a depending leading edge portion 26.

Figure 5:
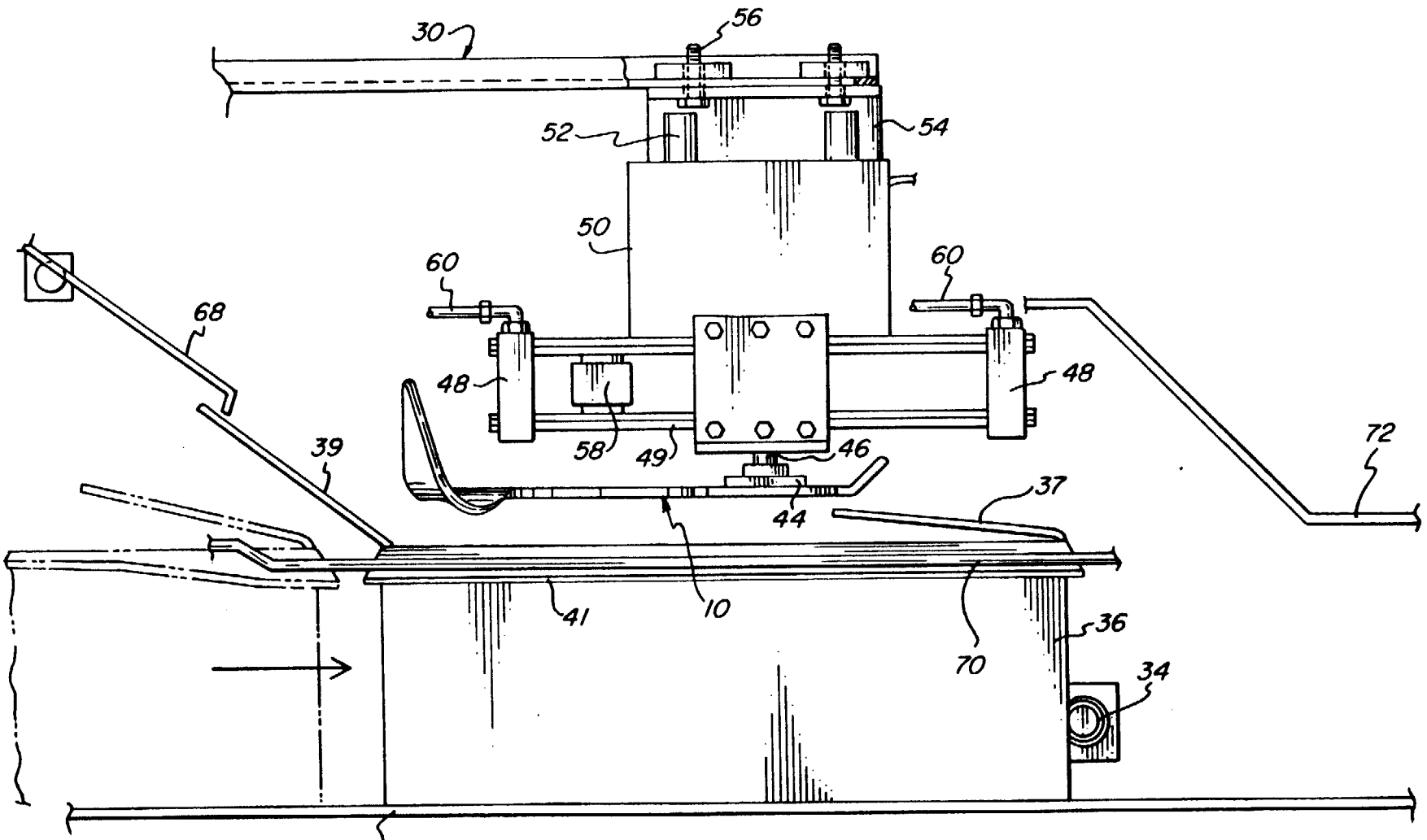
FIG. 5 is a fragmentary side elevational view of a conveyor and its frame with the flap opening apparatus embodying the present invention mounted thereon, and showing a carton in solid line advancing to the position where the apparatus will effect engagement with the leading flap, and also showing the trailing flap and side flaps in an opened position.
Figure 13:
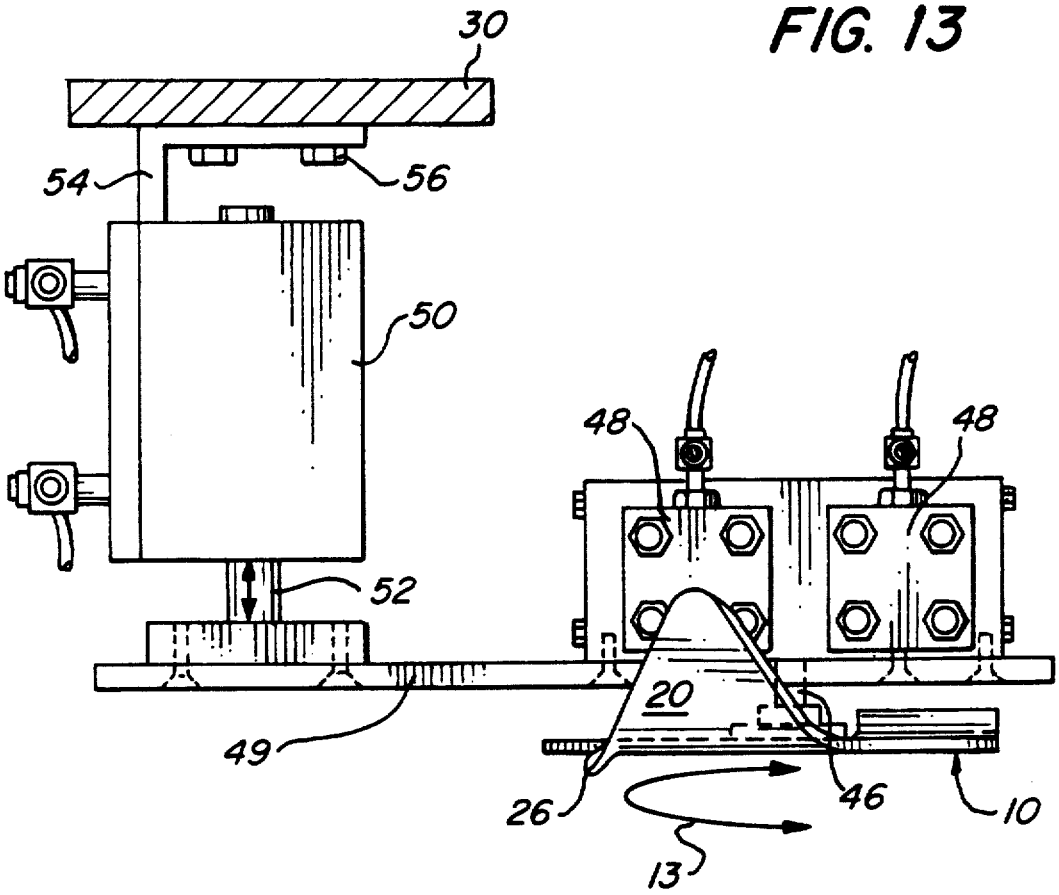
FIG. 13 is a partial view of the apparatus of the present invention showing the several air cylinders which are utilized to effect the motion of the arm vertically and horizontally.

Turning now to FIGS. 5 and 13, the arm 10 is secured to a mounting plate 44 which is supported on the shaft 46 which can be rotated in both directions about its axis through its engagement with a pair of rack gears (not shown) which are movable by a bidirectional air cylinder 48 which are seen in FIG. 13. Actuation of cylinder 48 will move a common rack in one direction reverse actuation of the other air cylinder 48 will move the common rack in the opposite direction so that the shaft 46 will be rotated by both gears. When the air flow to the cylinder 48 is reversed, it will effect motion of the rack in the opposite direction to effect rotation of the shaft 46 in the opposite direction. The rotation of the arm 10 is indicated by the double headed arrow 13 in FIG. 13.

The air cylinder 48 and arm 10 are supported on the bracket 49 which has its end supported on the pistons 52 of the air cylinders 50 so that it can be moved vertically relative to the frame 30 of the apparatus. The entire flap opening mechanism is supported on the mounting bracket 54 which in turn is secured to the frame 30 by the fasteners 56.

Also seen in FIG. 5 is the proximity detector 58 and some of the air lines 60 for supplying air to the several cylinders, and the carton sensor 34.

As seen in FIG. 5, the conveyor belt 32 extends horizontally and has disposed thereon a first carton 36 shown in solid line and a portion of a second carton shown in phantom line. The first carton 36 is shown as moving into the detection area for the sensor 34 which will send a signal to the control which actuates the carton flap opening mechanisms of the present invention.

As also seen in this figure, the trailing flap 39 has been pivoted into an open position by the element 68 and the side flaps 41 are being guided along in an open position by the side flap guides 70. Also shown is the leading flap guide 72 which will receive and hold down the leading flap 37 after it has been opened.

Figure 6:
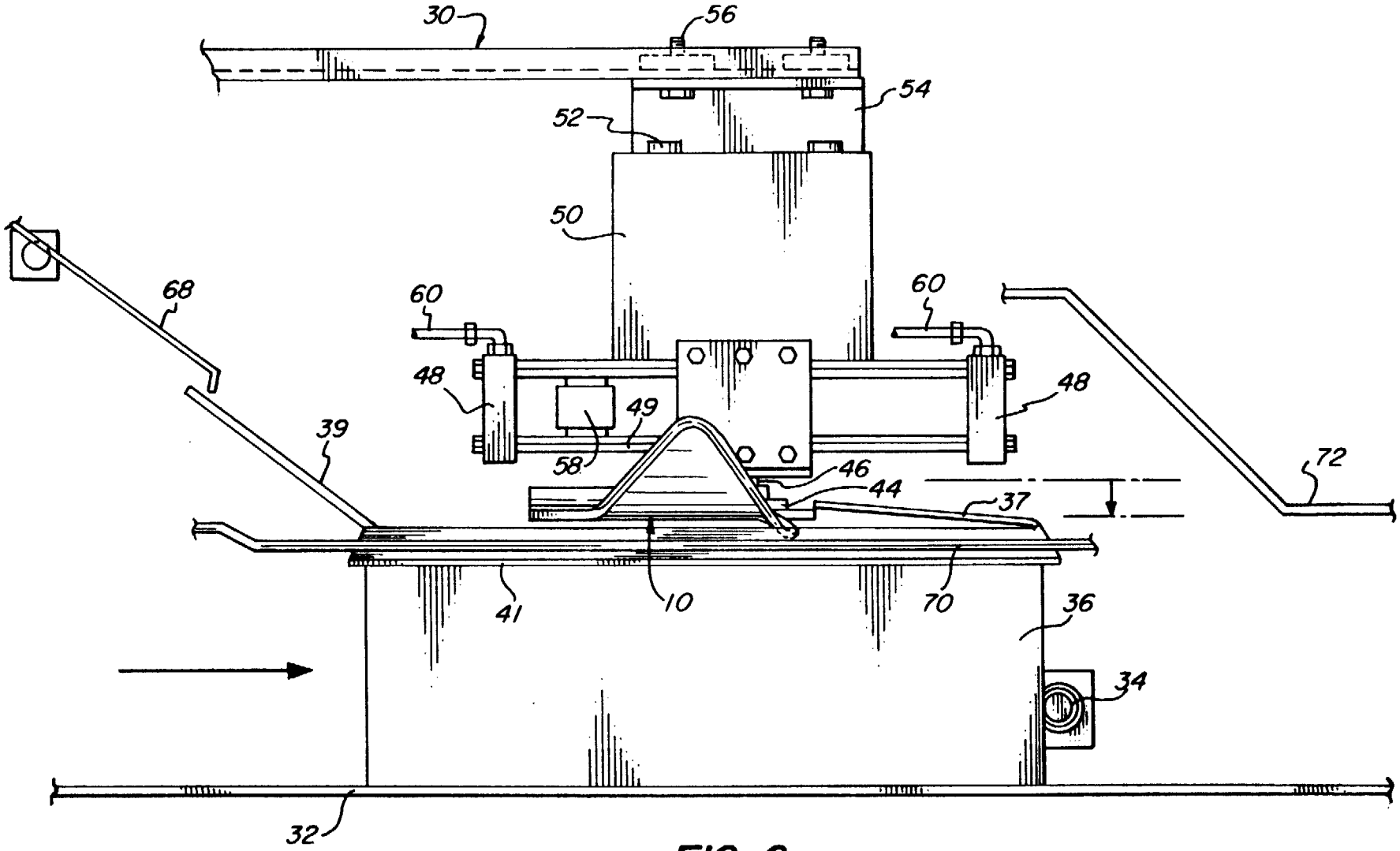
FIG. 6 is a similar view with the flap opening arm moved 90° and lowered into a position where it is about to engage the flap.
Figure 10:
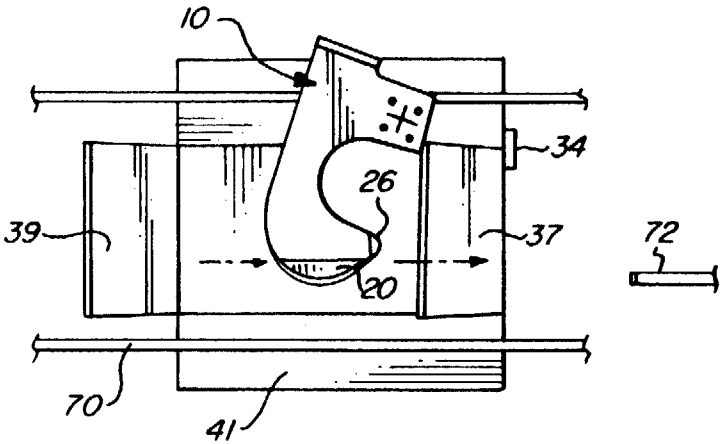
FIGS. 9–12 are partially diagrammatic views showing the carton and arm in plan view in the several positions of motion of the carton opening mechanism as the arm is moved to effect full opening of the flap.

In initial operation of the apparatus, the sensor 34 detects the arrival of the carton 36 and this causes air to be supplied to the rotary motion air cylinders 48 to rotate the arm 10 forwardly as seen in FIGS. 6 and 10 until the depending leading edge portion 26 moves under the trailing edge of the leading carton flap 37.

Figure 7:
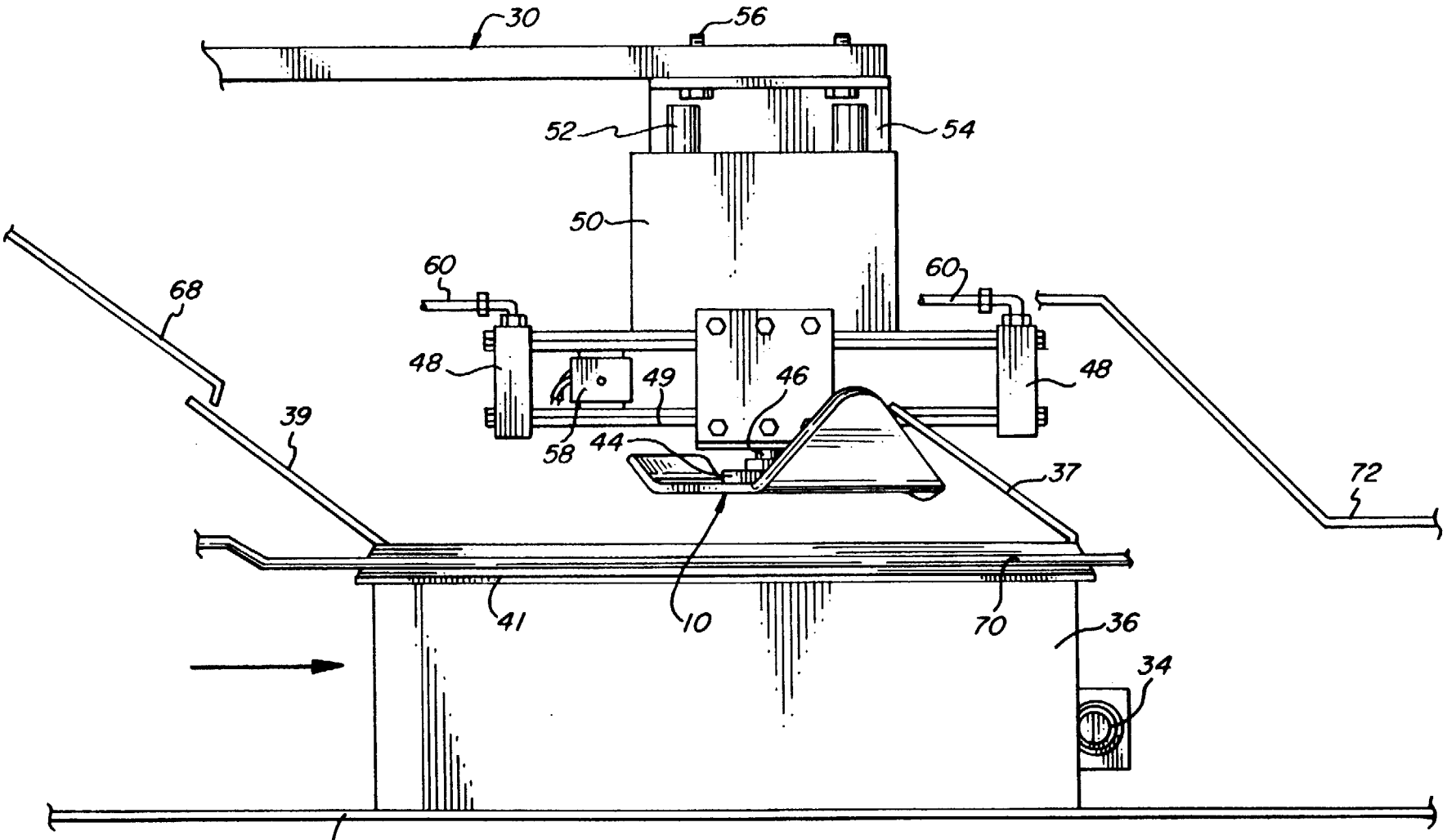
FIG. 7 is a similar view after the flap has been engaged and is being moved upwardly by further rotation and upward motion of the arm.
Figure 11:
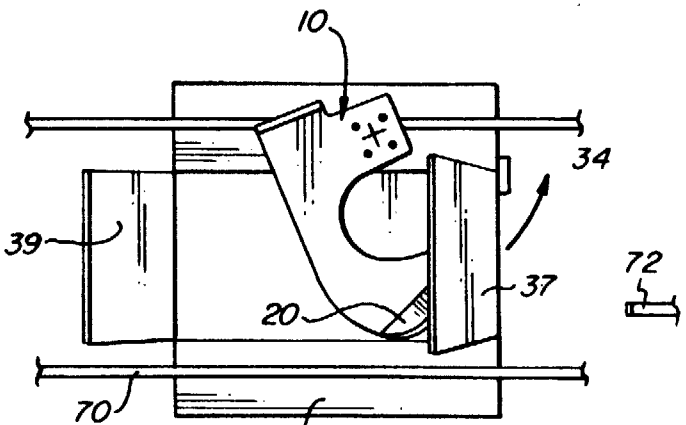

As seen in FIGS. 7 and 11, the depending leading edge portion 26 initially engages under the flap 37 and continues to rotate as it is being elevated by the vertical motion cylinders 50 to pivot the flap 3 upwardly.

Figure 8:
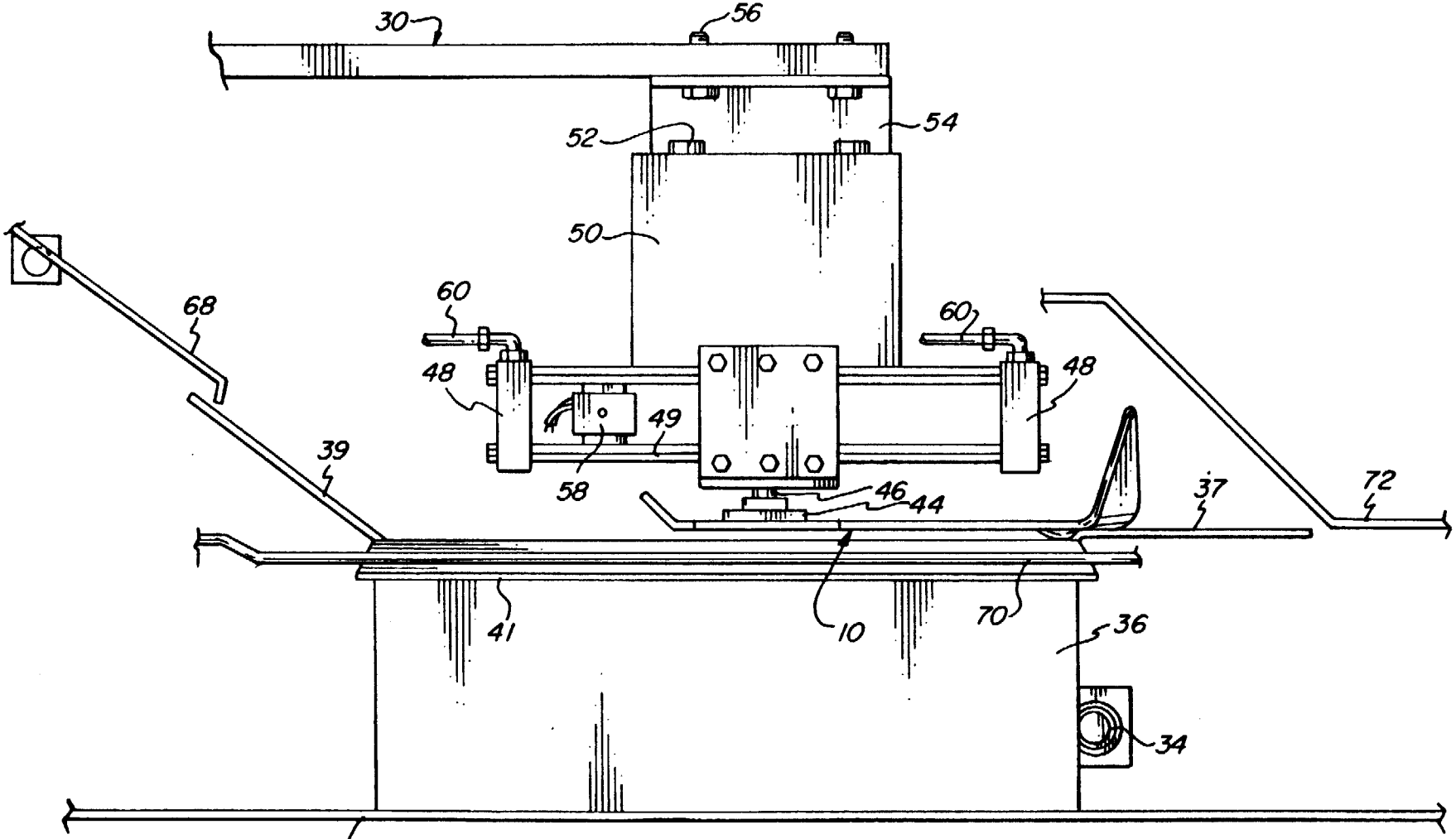
FIG. 8 is a similar view after the carton opening arm has moved the flap into a fully opened position.
Figure 12:
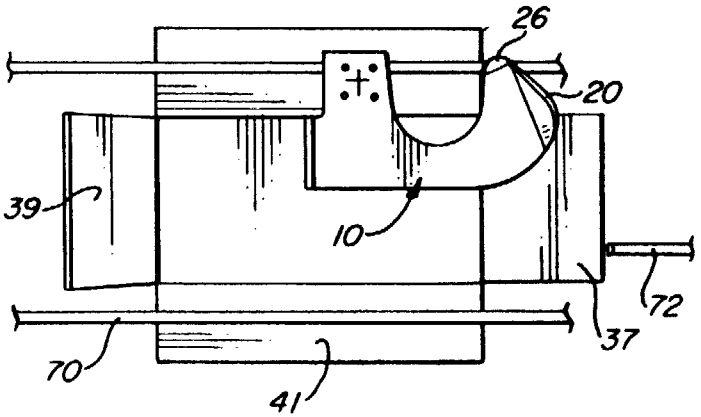
Figure 9:
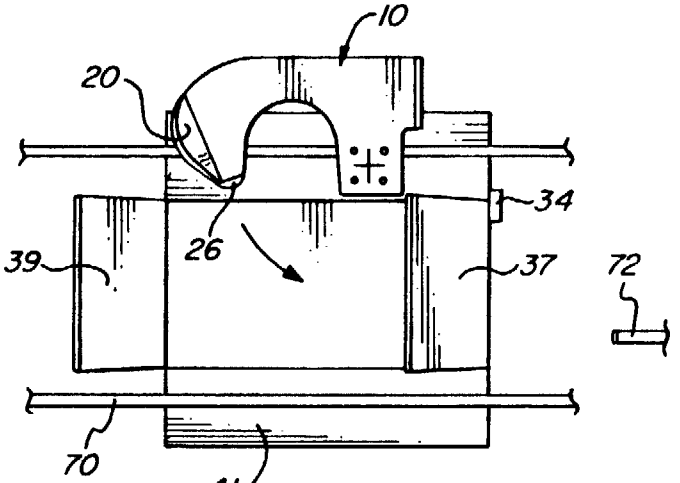

After the flap 37 has been pivoted beyond the vertical or 90° position and to a forward position where the proximity detector 58 senses that the arm 10 has completely rotated. At this point, the vertical motion cylinder 50 is actuated to move the arm 10 downwardly to move the carton flap into the fully opened horizontal position as seen in FIGS. 8 and 12, at which point it can move under the leading flap guide 72 for continued motion of the carton 36 along the conveyor 32. At this point, the arm 10 may now be rotated in the reverse direction by the air cylinders 48 and elevated by the air cylinders 50 into the initial position seen in FIGS. 5 and 9 wherein it is disposed out of the path of the next carton on the conveyor 32 until it is moved to the position where it is detected by the sensor 34.

The control for the apparatus may be a simple microprocessor permitting adjustment of the timing of the operating sequences and pressure in the air supply lines. Alternatively, simple adjustable timers and adjustable control valves for the air supply lines may be used. Both forms of controls are reliable and easy to use.

As will be readily appreciated, the configuration of the arm is particularly significant from the standpoint that it produces much of the pivotal action with respect to the carton flap 37 and works in cooperation with the air cylinders 48,50 which are effecting rotary and vertical motion. The depending leading edge portion 26 is of arcuate configuration so that it slices past and under the flap 37 in a biasing direction during rotation of the arm 10 to begin the lifting process as the flap 37 moves along its upwardly tapering surface. This upward camming motion is continued by the arcuate and tapering leading edge 22 of the upwardly extending section 20.

As will also be appreciated, the configuration of the arm presents a broad surface to push the carton flap past the vertical point of its motion so that the pivoting forces are distributed over a large area rather than concentrated, and it overcomes the inherent resistance in flaps to be manipulated from a single or limited area of force application. This produces a very high leverage action on the flap at its highest point to carry it beyond its fully vertical position to overcome most effectively the carton/flap score line resistance and thereby avoid buckling or creasing the front of the carton outwardly. The configuration of the arm also facilitates the transfer of the carton with its flaps open to the next station by serving to lower and position the trailing edge flap by the camming surface provided by the tapering surface of the upstanding flange 24 on the mounting finger 12, as will best be appreciated from FIG. 12 of the attached drawings.

As will be readily appreciated, the timing and the extent of vertical and horizontal motion can be readily adjusted with variation in the size of the cartons. Moreover, the entire assembly may be moved upwardly and downwardly on its mounting bracket, and the speed of air flow to the cylinders to control the speed of vertical and horizontal motion is also readily adjustable.

Various modifications can be made in the mounting arrangement for the vertical motion and horizontal motion operating mechanisms and for support of those mechanisms upon the frame of the conveyor. However, the assembly shown has proven reliable and is readily adjustable for long lived and versatile operation.

Thus, it can be seen from the foregoing detailed specification and attached drawings that the flap opening assembly of the present invention may be readily mounted upon existing conveyor systems in a non-interfering position, and it may be readily adjusted for various carton sizes and conveyor speeds. The elements of the assembly are relatively simple and durable, and they may be assembled rapidly to provide a relatively trouble free operating system.

Having thus described the invention, what is claimed is:

1. For use in a carton conveying apparatus having a frame and a conveyor providing a path along which cartons are moved, a carton flap opening assembly comprising:

(a) a horizontally disposed arm having a mounting portion at one end and a flap engaging portion extending generally horizontally therefrom, said flap engaging portion having a first section adjacent said mounting portion and a flap lifting section at its outer end, a said flap lifting section having a leading edge, an outer edge and a trailing edge, said lifting section having depending portion on its leading edge and an upwardly extending portion behind said depending portion and along said outer edge;

(b) a rotating mechanism having mounting means for supporting said mounting portion for rotation of said arm about a vertical axis spaced to one side of the associated conveyor path;

(c) a vertical motion mechanism supporting said rotating mechanism and thereby said arm for movement vertically relative to the plane of the associated conveyor path;

(d) means for mounting said vertical motion mechanism on the frame of the associated conveying apparatus; and (e) control means for operating said rotating and vertical motion mechanisms in response to the position of a carton moving along the associated conveyor path.

2. The carton flap opening assembly of claim 1 wherein said arm is of generally U-shaped configuration providing a pair of fingers and a bight therebetween with the end of one finger providing said mounting portion, said bight providing said trailing edge section, and said depending leading edge portion and upwardly extending section being provided by the outer portion of the other finger.

3. The carton flap opening assembly in accordance with claim 1 wherein said arm has an upstanding flange along its side adjacent said mounting portion.

4. The carton flap opening assembly in accordance with claim 1 wherein said depending leading edge portion and said upwardly extending section have an arcuate edge.

5. The carton flap opening assembly in accordance with claim 1 wherein said control means operates said rotating mechanism to rotate said arm through approximately 180° to initially engage under the flap of an associated carton and pivot it into an open position while concurrently operating said vertical motion mechanism to raise and then lower said arm during said rotation as the flap is being pivoted into the open position.

6. The carton flap opening assembly in accordance with claim 1 wherein said vertical motion mechanism includes at least one cylinder and piston supporting said rotary motion mechanism.

7. The carton flap opening assembly in accordance with claim 6 wherein said cylinder is secured to said mounting means.

8. The carton flap opening assembly in accordance with claim 1 wherein said rotary motion mechanism includes at least one cylinder and piston for rotating said mounting means for said arm.

9. For use in a carton conveying apparatus having a frame and a conveyor providing a path along which cartons are moved, a carton flap opening assembly comprising:

(a) a horizontally disposed arm having a mounting portion at one end and a flap engaging portion extending generally horizontally therefrom, said flap engaging portion having a first section adjacent said mounting portion and at its a slap lifting section outer end, a depending arcuate portion on its leading edge and an upwardly extending portion behind said depending portion and along said outer edge said upwardly extending section having an arcuate edge;

(b) a rotating mechanism having mounting means for supporting said mounting portion for rotation of said arm about a vertical axis spaced to one side of the associated conveyor path;

(c) a vertical motion mechanism supporting said rotating mechanism and thereby said arm for movement vertically relative to the plane of the associated conveyor path; and (d) means for mounting said vertical motion mechanism on the frame of the associated conveying apparatus; and (e) control means for operating said rotating mechanism to rotate said arm through approximately 180° to initially engage under the flap of an associated carton and pivot it into an open position while concurrently operating said vertical motion mechanism to raise and then lower said arm during said rotation as the flap is being pivoted into the open position.

10. The carton flap opening assembly of claim 9 wherein said arm is of generally U-shaped configuration providing a pair of fingers and a bight therebetween with the end of one finger providing said mounting portion, said bight providing said trailing edge section, and said depending leading edge portion and upwardly extending section being provided by the outer portion of the the finger.

11. The carton flap opening assembly in accordance with claim 9 wherein said vertical motion mechanism includes at least one cylinder and piston supporting said rotary motion mechanism and wherein said cylinder is secured to said mounting means.

12. The carton flap opening assembly in accordance with claim 11 wherein said rotary motion mechanism includes at least one cylinder and piston for rotating said mounting means for said arm.

13. In a carton conveying apparatus, the combination comprising:

(a) a frame;

(b) a conveyor providing a travel path along which cartons are moved;

(c) a horizontally disposed arm having a mounting portion at one end and a flap engaging portion extending generally horizontally therefrom, said flap engaging portion and a flap lifting section having a trailing edge section adjacent said mounting, portion at its outer end, and said flap lifting section having a leading edge, an outer edge and a trailing edge, said lifting section having a depending portion on its leading edge with an upwardly extending portion behind said depending portion and along said outer edge end section therebehind;

(d) a rotating mechanism having mounting means for supporting said mounting portion for rotation of said arm about a vertical axis spaced to one side of said conveyor and its carton path;

(e) a vertical motion mechanism supporting said rotating mechanism and thereby said arm for movement vertically relative to the plane of the conveyor path; and (f) means mounting said vertical motion mechanism on said frame; and (g) control means for operating said rotating and vertical motion mechanisms in response to the position of a carton moving along the associated conveyor path.

14. The carton conveying apparatus in accordance with claim 13 wherein said arm is of generally U-shaped configuration providing a pair of fingers and a bight therebetween with the end of one finger providing said mounting portion, said bight providing said trailing edge section, and said depending leading edge portion and upwardly extending section being provided by the outer portion of the other finger.

15. The carton conveying apparatus in accordance with claim 13 wherein said arm has an upstanding flange along its side adjacent said mounting portion and wherein said upwardly extending section has an arcuate edge.

16. The carton conveying apparatus in accordance with claim 13 wherein said vertical motion mechanism includes at least one cylinder and piston supporting said rotary motion mechanism, said cylinder being secured to said mounting means.

17. The carton conveying apparatus in accordance with claim 16 wherein said rotary motion mechanism includes at least one cylinder and piston for rotating said mounting means for said arm.

* * * * *

UNITED STATES PATENT AND TRADEMARK OFFICE

CERTIFICATE OF CORRECTION

PATENT NO. : 5,269,742

DATED : December 14, 1993

INVENTOR(S) : G. William Crouch and Warren Minkler

It is certified that error appears in the above-indentified patent and that said Letters Patent is hereby corrected as shown below:

Column 6, line 39, delete "the" (second occurrence), and insert --other--.

Column 6, line 57, delete "and a flap lifiting section";
line 58, delete "trailing edge";
line 59, delete "," (first occurrence), and delete "at its outer end,";
line 60, after "section" insert --at its outer end, and said flap lifting section--;
lines 61-62, delete "a depending"; and
line 64, after "edge" insert --;--; and delete "end section therebehind,".

Signed and Sealed this

Ninth Day of August, 1994

Bruce Lehman

*Attest:*

BRUCE LEHMAN

*Attesting Officer*

*Commissioner of Patents and Trademarks*